US005098532A

United States Patent [19]

Thompson et al.

[11] Patent Number: 5,098,532

[45] Date of Patent: Mar. 24, 1992

[54] PROCESS FOR PRODUCING SODIUM HYDROXIDE AND AMMONIUM SULFATE FROM SODIUM SULFATE

[75] Inventors: Jack S. Thompson, Moose Jaw, Canada; David Genders, East Amherst, N.Y.

[73] Assignee: Ormiston Mining and Smelting Co. Ltd., Moose Jaw, Canada

[21] Appl. No.: 705,235

[22] Filed: May 24, 1991

[51] Int. Cl.[5] ..... C25B 1/14

[52] U.S. Cl. ..... 204/98; 204/104; 204/129; 204/182.4

[58] Field of Search ..... 204/98, 104, 93, 182.4, 204/129

[56] References Cited

U.S. PATENT DOCUMENTS

| | | | |
|---|---|---|---|
| 3,907,654 | 9/1975 | Radd et al. | 204/98 |
| 4,561,945 | 12/1985 | Coker et al. | 204/98 |
| 4,613,416 | 9/1986 | Kau et al. | 204/98 |
| 4,707,234 | 11/1987 | Mori et al. | 204/296 |

*Primary Examiner*—John Niebling

*Assistant Examiner*—David G. Ryser

*Attorney, Agent, or Firm*—Allegretti & Witcoff, Ltd.

[57] ABSTRACT

A process for producing sodium hydroxide and ammonium sulfate by electrolysing an aqueous solution of sodium sulfate is disclosed. The process is carried out in a three-compartment electrolytic cell having a central compartment separated from an anode and a cathode compartment by, respectively, anion selective and cation selective ion exchange membrane. The solution of sodium sulfate is circulated through the central compartment, while solutions of sodium hydroxide and ammonium sulfate are circulated, respectively, through the cathode and the anode compartment. During the process, ammonia is added to the anolyte to at least partially neutralize sulfuric acid produced in the anode compartment and reduce the back migration of protons from the anolyte into the central compartment. As a result, high purity ammonium sulfate of commercial value higher than that of sulfuric acid is produced with high current efficiency and in concentrations higher than those achievable for sulfuric acid.

24 Claims, 1 Drawing Sheet

PROCESS FOR PRODUCING SODIUM HYDROXIDE AND AMMONIUM SULFATE FROM SODIUM SULFATE

BACKGROUND OF THE INVENTION

This invention relates to manufacturing of sodium hydroxide. More particularly, the invention relates to manufacturing of sodium hydroxide and ammonium sulfate by electrolyzing sodium sulfate.

Demonstrated worldwide demand for some sodium-based chemicals, particularly for sodium hydroxide (caustic soda), has been on the rise in recent years. This strong demand, which is forecast to continue, keeps this chemical in tight supply position, thereby holding the price at a high level. This trend is not the same with respect to all sodium-based chemicals. In particular, the demand for sodium sulfate and, as a consequence, the price of this chemical is declining at the same time as the demand for caustic soda is rising.

This declining trend in the demand for and prices of sodium sulfate combined with the strong demand for and relatively high prices of other sodium-based chemicals, in particular of caustic soda, created a need for a simple and economical process for producing sodium hydroxide from sodium sulfate as feedstock. This need is even more strongly perceived in countries endowed with vast natural resources of sodium sulfate. This is, for example, the case in Canada, which has large deposits of natural sodium sulfate located in Southern Saskatchewan.

The most direct process for producing sodium hydroxide from sodium sulfate is the electrolytic conversion of an aqueous solution of sodium sulfate into aqueous solutions of sulfuric acid and caustic soda. Numerous implementations of this process are known in the prior art. Most of them make use of electrolytic cells employing diaphragms or ion permeable membranes to separate the product solutions from the feed solution, thus avoiding contamination of the products by the feedstock material.

U.S. Pat. No. 2,829,095 discloses a process for the production of acidic and alkaline solutions by electrolysis of a salt solution in a multi-compartment electrolytic cell partitioned by a plurality of anion and cation exchange membranes. The patent also discloses the use of the process for direct production of sodium hydroxide and sulfuric acid from Glauber's salt (sodium sulfate decahydrate).

U.S. Pat. Nos. 3,135,673 and 3,222,267 claim a method and apparatus for converting aqueous electrolytic salt solutions to their corresponding acid and base solutions. A three or four compartment electrolytic cell separated by a cation exchange membrane and one or two porous, non-selective diaphragms is used for this purpose. When a solution of sodium sulfate is used as the salt solution, solutions of sodium hydroxide and sulfuric acid or sodium bisulfate are produced.

U.S. Pat. No. 3,398,069 claims a process for the electrolysis of an aqueous saline electrolyte in a multicellular device having cells separated by gas permeable electrodes and further partitioned by microporous fluid-permeable diaphragms or ion-permselective membranes. When applied to a solution of sodium sulfate, the process produces solutions of sodium hydroxide and sulfuric acid.

U.S. Pat. No. 3,907,654 discloses an electrolytic cell particularly useful in electrolysis of sodium sulfate to form sulfuric acid and sodium hydroxide. The cell, which does not employ any ion permeable membranes, comprises a housing having a parent solution chamber and two electrode compartments located on the lower side of the housing and separated from each other but in communication with the parent solution chamber and positioned vertically beneath or above. Mounted within the electrode compartments are an anode and a cathode, each of which is porous to permit passage of a product solution therethrough. The product solutions of sodium hydroxide and sulfuric acid separated by gravity forces are withdrawn through the porous electrodes.

U.S. Pat. No. 4,561,945 claims a process for producing sulfuric acid and caustic soda by electrolysis of an alkali metal sulfate in a three compartment membrane cell having a hydrogen depolarized anode. Hydrogen gas in the anode chamber is oxidized to produce hydrogen cations which migrate to the central (buffer) chamber through a membrane and combine with the sulfate anions from the alkali metal sulfate solution to produce sulfuric acid. Alkali metal ions are transported across another membrane to the cathode chamber to produce caustic and gaseous hydrogen. Both membranes used in the cell are cation selective membranes.

A similar process for increasing concentration of sulfuric acid in solutions containing an alkali metal sulfate, sulfuric acid and alkaline earth metal ions is disclosed in U.S. Pat. No. 4,613,416. Also in this case the anode compartment and the cathode compartment of a three compartment cell are each bounded by cation exchange membranes.

SUMMARY OF THE INVENTION

The development of ion selective membranes has promoted use of three compartment electrochemical cells partitioned by both cation and anion selective membranes. The use of such a cell for electrolysis of sodium sulfate has been disclosed, for example, by J. P. Millington ("An electrochemical unit for the recovery of sodium hydroxide and sulfuric acid from waste streams", in: Ion-Exchange Membranes, D. S. Flett, Ed., Ellis Harwood Ltd. Publishers, Chichester, 1983, p. 195). The cell consists of a central (feed) compartment, through which a solution of sodium sulfate is circulated, an anode compartment and a cathode compartment through which an anolyte and a catholyte, respectively, are circulated. The anode compartment is separated from the central compartment by an anion selective membrane and the cathode compartment by a cation selective membrane. When current is passed between the electrodes situated in the anode and cathode compartments, sodium ions and sulfate ions migrate across ion selective membranes into the cathode and anion compartments, respectively, where they combine with hydroxy and hydrogen ions generated by electrolysis of water. As the process proceeds, the concentrations of sodium hydroxide and sulfuric acid in the catholyte and anolyte increase, whereas the concentration of sodium sulfate in the central compartment decreases by an equivalent amount.

However, as the concentration of sulfuric acid in the anolyte increases, so does the rate of migration of protons back into the central compartment. This lowers the current efficiency for the production of sulfuric acid, as measured in the anolyte only. It leads eventually to competition between protons and sodium ions for the transport of charge across the cation exchange membrane and into the catholyte, thus lowering the current efficiency for the production of sodium hydroxide, as measured in the catholyte only. This problem can be partly eliminated by using membranes having low back-diffusion rates. However, the use of such membranes usually results in an increase of the total cell voltage, thus increasing the power consumption and lowering the overall process efficiency.

It is accordingly an object of the invention to provide a new process for producing sodium hydroxide by electrolysing an aqueous solution of sodium sulfate in an electrochemical cell partitioned by both cation and anion selective membranes, which process substantially reduces back migration of protons from the anolyte into the feed compartment.

It is another object of the invention to provide a process for producing sodium hydroxide by electrolysing an aqueous solution of sodium sulfate, which process also produces ammonium sulfate with high current efficiency.

It has now been found that the problem of the back migration of protons from the anolyte into the feed compartment in a three compartment cell of the type described above can be overcome or substantially reduced by adding ammonia to the anolyte to convert sulfuric acid to ammonium sulfate or ammonium hydrogen sulfate, thus avoiding the build-up of the acid in the anolyte compartment and subsequent back migration of protons across the anion selective membrane.

Thus, the invention provides a process for producing sodium hydroxide, which process comprises electrolysing an aqueous solution of sodium sulfate in an electrolytic cell having at least one anode compartment and at least one cathode compartment, said anode compartment containing an anolyte and having an anode located therein, said cathode compartment containing a catholyte and having a cathode located therein, said anode compartment and said cathode compartment being separated from the sodium sulfate solution by an anion selective ion exchange membrane and a cation selective ion exchange membrane, respectively, wherein during the process ammonia is added to the anolyte to at least partially neutralize sulfuric acid produced in the anode compartment.

Beside the advantages mentioned above, the present invention has also the considerable advantage that, in addition to producing the desired sodium hydroxide, it also produces ammonium sulfate, which is of higher commercial value than sulfuric acid. Moreover, ammonium sulfate produced by the process of the invention is of a purity such that it can immediately be used as fertilizer. Because of the substantially reduced back migration of protons from the anolyte into the feed compartment, the efficiency of the production of ammonium sulfate is substantially higher than efficiencies achievable when sulfuric acid is produced. While the current efficiency of the production of ammonium sulfate according to the invention is usually higher than 95%, the current efficiency of the production of sulfuric acid under comparable process conditions is normally lower than 70%. Also final concentrations of ammonium sulfate which may be achieved without adversely affecting the current efficiency of the process are substantially higher than concentrations of sulfuric acid (up to about 37% for ammonium sulfate versus about 15% for sulfuric acid). Higher concentrations of ammonium sulfate, up to the solubility limits, are possible.

To carry out the process according to the invention, any electrolytic flow cell using a three compartment configuration can be used in either continuous or batch mode of operation.

In the process, the anolyte, the catholyte and the feed solution are circulated through the respective compartments of the cell at a flow rate depending on the cell used, typically of from about 0.1L/min to about 20L/min. The current density is limited by the efficiency considerations (current efficiency of the process decreases with growing current density) and by the stability of the membranes used. Typical current densities are in a range of from about 1 $mA/cm^2$ to about 500 $mA/cm^2$.

The feed solution of sodium sulfate may have a concentration of from about 0.1M to the solubility limit. The concentration of from about 1M to about 3.5M is preferred. The concentration of from about 2M to about 3M is particularly preferred. For concentrated feed solutions, it may be necessary to heat the solution prior to circulating it through the cell, to prevent the crystallization of the salt.

The feed solution should be as free as possible of heavy metal contaminants that are usually present in the naturally occurring Glauber's salt. If this salt is used as a starting material, the bulk of heavy metal ions can be precipitated, for example, by addition of sodium carbonate and/or sodium hydroxide to a solution of the salt. The remaining amounts of polyvalent cations, in particular of calcium and magnesium ions, can be removed by treating the resulting solution with an ion exchange resin, e.g. by passing the solution through an ion exchange column packed with a suitable ion exchange material, for example Duolite* C-467 from Rohm and Haas, or an equivalent material. After such a treatment the heavy metal ion concentration normally will not exceed about 20 ppb.

The catholyte and the anolyte can both be water, but it is preferred that they are solutions of sodium hydroxide and ammonium sulfate, respectively, as this gives improved conductivity. In the case of sodium hydroxide solution, the starting concentration should be in the range of from about 0.01M to about 9M. In the case of ammonium sulfate solution the starting concentrations should be in the range of from about 0.01M to about 3.5M. A concentration of about 3M is preferred. The choice of the starting concentrations of the anolyte and the catholyte may be also affected by the mode of operation of the electrolytic cell. For example, for the continuous mode of operation, starting concentrations closer to the upper limits of the above ranges are preferred.

To avoid an excessive accumulation of hydrogen ions in the anolyte, ammonia in either the liquid or the gaseous form is introduced into the anolyte at such a rate as to keep the pH of the solution at a predetermined level. The choice of suitable pH of the anolyte may be affected by several other factors, in particular by the ion exchange membranes and anode materials used. Generally, the pH of the anolyte may be maintained at any level in *Trade-Mark the range of from about 0.5 to about 12. A pH of from about 0.5 to about 7 is preferred and pH of from about 0.5 to about 3.5 is particularly preferred. It appears that under these acidic conditions there is little or no anode corrosion as well as no or very little formation of nitrogen and ammonium nitrate due to electrooxidation of ammonia.

The materials for electrodes, beside providing good current conduction, must be corrosion resistant under the operating conditions of the cell. Suitable cathodes are low hydrogen over potential cathodes, for example gold, platinum, nickel or stainless steel. Because of the lower cost, nickel and stainless steel are preferred.

The choice of the anode material is mostly restricted by the presence of ammonia in the anolyte solution. Under alkaline conditions (pH 9 to 12) anodes made of some materials, such as nickel, graphite and stainless steel may corrode quickly. In this range of pH anodes made of platinum, platinized titanium, magnetite or anodes of low oxygen over potential such as DSA* type electrodes (iridium or platinum oxides on a titanium substrate) are preferred. Under acidic conditions (pH 0.5 to 2) DSA-$O_2$ anodes are preferred. However, less expensive materials, such as lead dioxide on titanium or Ebonex* (material comprising $Ti_4O_7$) may be used. Lead dioxide on lead would be even less expensive anode material, but there exists a possibility that this material might liberate lead into the anolyte, thus making ammonium sulfate unacceptable for use as a fertilizer.

The ion-selective membranes used to separate the anode and cathode compartments from the central compartment are essentially *Trade-Mark insoluble, synthetic, polymeric organic ion-exchange resins in sheet form. Those selective to cations usually have sulfonate and/or carboxylate groups bound to the polymers; those selective to anions usually have amino functionality bound to the polymer. These ion exchange membranes are commercially available under various trade names, for example Nafion* or Flemion* (cation exchange membranes) or Neosepta* (anion exchange membranes). Cation selective membranes made of stable perfluorinated cation exchange resins are preferred.

Even though, in principle, any cation or anion exchange membrane may be used in the process according to the invention, their choice may be in practice limited to those showing sufficiently good stability under operating conditions of the electrolytic cell. For example, the choice of the anion selective membrane maybe limited by both the concentration of sulfate ion and/or ammonia in the anolyte and the presence of hydroxyl ions in the feed solution, due to the back migration of hydroxyl ions from the catholyte. Of the membranes showing good stability, membranes having high ionic selectivity and low electrical resistance are preferred. A person skilled in the art will be able to choose suitable membranes without difficulty.

An example of the anion exchange membrane preferred for carrying out the process of the invention is Neosepta AMH membrane, which shows good stability at the anolyte pH in a range of 1–12. Examples of preferred cation exchange membranes are perfluorinated membranes such as Nafion and Flemion membranes, which show good stability for NaOH concentration up to 50%. *Trade-Mark

DESCRIPTION OF THE PREFERRED EMBODIMENTS

Figure 1:
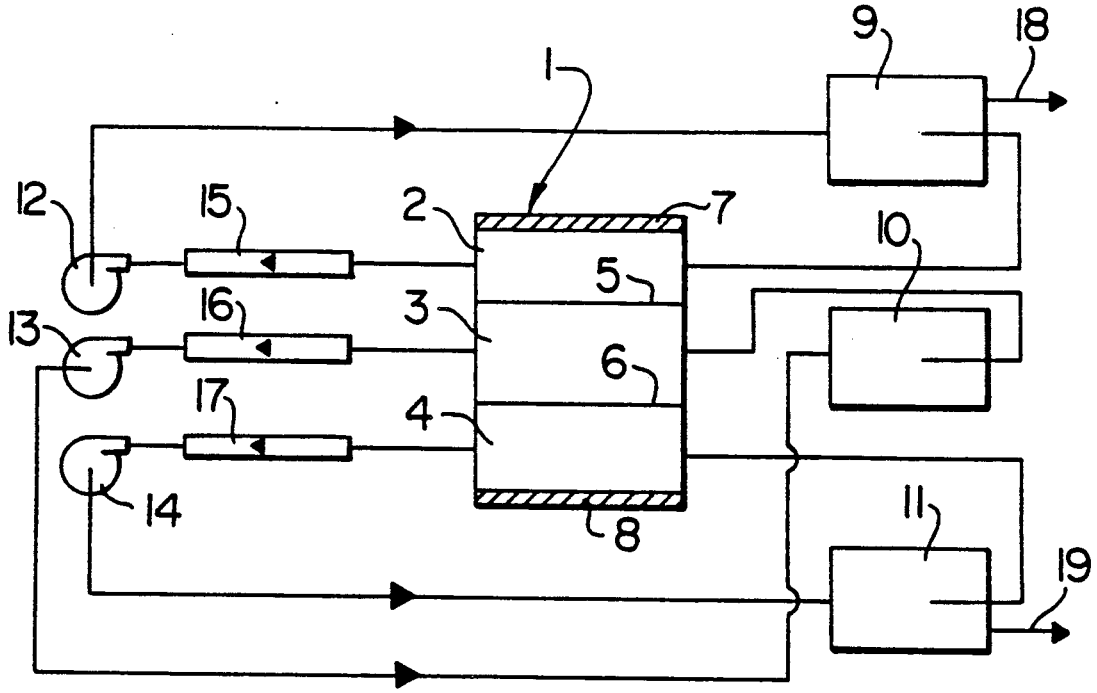
FIG. 1 represents schematically the set-up of a three-compartment electrolytic cell used for conducting flow cell electrolyses and FIG. 2 represents schematically the configuration of a three-compartment electrolytic cell for conducting the process according to the invention.

Turning now to the Figures, a three-compartment electrolytic cell 1 is divided into a cathode compartment 2, a central (feed) compartment 3 and an anode compartment 4 by a cation exchange membrane 5 and an anion exchange membrane 6. A cathode 7 and an anode 8 are situated in the cathode compartment 2 and the anode compartment 4, respectively.

Figure 2:
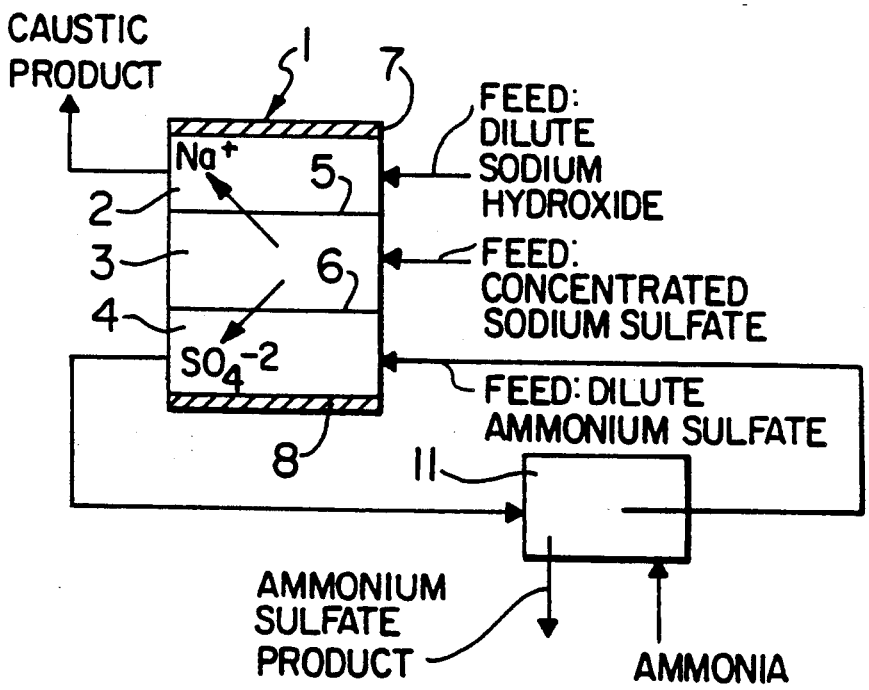

To operate the cell, storage reservoirs 9, 10 and 11 are charged with a catholyte solution, a feed solution and an anolyte solution, respectively. These solutions are circulated through respective compartments of the cell by pumps 12, 13 and 14 at a flow rate measured by flow meters 15, 16 and 17. As a direct current is passed from a source (not shown in the drawings) between the cathode 7 and the anode 8, sodium ions from the feed solution are transported through the cation exchange membrane 5 into the catholyte, whereas sulfate ions are transported through the anion exchange membrane into the anolyte, as shown in FIG. 2. At the same time hydroxide ions and protons are produced in the cathode compartment 2 and the anode compartment 4, respectively, due to the following electrode reactions:

anode: $2H_2O = 4H^+ + O_2$ cathode: $2H_2O \rightarrow 2OH^- + H_2$

Hydrogen and oxygen produced in these reactions are vented through outlets 18 and 19, respectively.

The combined result of the above processes is a build-up of sodium hydroxide in the catholyte and sulfuric acid in the anolyte. The build-up of sulfuric acid in the anolyte can be prevented by introducing ammonia into the anolyte, as shown schematically in FIG. 2.

EXAMPLE 1

Glass Cell Electrolyses

Glass cell electrolyses were conducted in H-type cells to check the stability of various anode materials to ammonia solution. The anolyte was 1M ammonium sulfate maintained at pH 9–12 by periodic additions of concentrated $NH_4OH$. A Nafion 417 cation exchange membrane was used to separate the anolyte from the catholyte, which was 1M NaOH with a graphite rod as the cathode. A constant current of 1A (200 mA/cm$^2$) was supplied by an ESC Model 420 power supply in conjunction with a Model 410 potentiostat in the galvanostatic mode. Anodes were 5 cm$^2$ flags. Nickel, graphite, 316 stainless steel, magnetite ($Fe_3O_4$), platinized titanium, and DSA-$O_2$ materials were tested. $PbO_2$/Ti and Ebonex ($Ti_xO_4$) anodes were also tested at a lower anolyte pH of 1–2. The anodes and anolyte were observed for changes in appearance and in some cases anode weight loss was measured. Electrolyses were performed for 4–24 hours depending on the extent of anode corrosion.

Table 1 shows the results of corrosion tests carried out in glass cells. The first three anode materials tested (nickel, graphite, and 316 stainless steel) quickly corroded in ammonium sulfate+ammonium hydroxide as evidenced by anolyte color changes within 4 hours of electrolysis. The next three materials tested (magnetite, platinized titanium, and DSA-$O_2$) showed no visible evidence of corrosion after 24 hours of electrolysis. Slight weight losses were seen at platinized titanium and magnetite, but not at DSA-$O_2$, indicating that it was the best anode for use in ammonia solutions.

TABLE 1

Stability of Anode Materials to Ammonia Solutions

| Anode Material | Solution | Weight Loss. mg/1000 coul | Corrosion |
|---|---|---|---|
| Nickel | Lavender | — | Moderate |
| Graphite | Brown | — | Severe |
| 316 SS | Yellow | — | Severe |
| Magnetite | No Change | 11.7 | Slight |
| Pt/Ti | No Change | 3.3 | Slight |
| DSA-$O_2$ | No Change | 0 | None |
| $PbO_2$/Ti | No Change | — | None |
| Ebonex | No Change | — | Slight |

In acid ammonium sulfate, $PbO_2$/Ti showed no signs of corrosion, while Ebonex was slightly pitted. Thus lead dioxide on titanium may be an alternative anode material to DSA-$O_2$ under acidic conditions. However, in the manufacture of such electrodes the titanium is first platinized to avoid peeling of the $PbO_2$ layer, and consequently such electrodes are as expensive as DSA-$O_2$. Lead dioxide on lead would be a less expensive material but may corrode lead into the anolyte making it unacceptable for use as a fertilizer.

EXAMPLE 2

Purification of Glauber's Salt

Raw Glauber's salt was dissolved in hot water to give a solution with a concentration greater than 2M. Suspended impurities were flocculated with an anionic flocculating agent (Percol* 156, Allied Colloids) and the resulting suspension filtered. The calcium and magnesium contents of the solution at this stage were 442 ppm and 224 ppm, respectively. Sodium carbonate was then added to the resulting solution and the pH was raised to 12 with sodium hydroxide to precipitate out the calcium and magnesium ions. The resulting fine precipitate was flocculated and removed by filtration. This gave a solution that contained 61.6 ppm Ca and less than 0.1 ppm Mg. The solution was then passed through an ion exchange column (Ionac SR-5, Sybron Chemicals) to remove any last traces of polyvalent cations from the solution. Analysis of this solution showed that the heavy metal ion concentrations had been reduced to below the limits of detection, that is below 0.5 ppm Ca and 0.1 ppm Mg. The purified solution was then diluted with water to the required concentration of 2M before being used for flow cell experiments.

EXAMPLE 3

Electrolytic Production of Sodium Hydroxide and Ammonium Sulfate

Flow cell electrolyses of Glauber's salt purified described in Example 2 above were performed in a MP Cell* (ElectroCell AB, Sweden) using a three compartment configuration as shown in FIG. *Trade-Mark 1. Initially, ammonia was introduced to the anolyte from a dropping funnel containing 100% liquid $NH_3$ to maintain an excess of ammonia in solution giving a pH of 9–11. Later experiments (#176-91 to 200-14) utilized gaseous $NH_3$ addition from an ammonia cylinder through a glass sparger tube into the anolyte. The compartments were charged with the following solutions for flow cell experiments:

| | |
|---|---|
| Catholyte: | 1L 1M (or 2.5M) NaOH |
| Feed: | 2L 1.75M $Na_2SO_4$ |

-continued

| | |
|---|---|
| Anolyte: | 1L 1M $(NH_4)_2SO_4$ |

The solutions were circulated through the respective compartments of the cell by March* MX-MT3 pumps at a flow rate of 0.4 gal/min. A Sorenson* DCR 60-45B power supply provided a constant current of 20 amps (200 mA/$cm^2$) to the cell and the charge was followed by using a coulometer (ESC Model 640) in the circuit. Anolyte pH was measured by a Corning* combination probe mounted in line and connected to a Cole-Parmer* 5997-20 pH meter. Membranes used were Neosepta* ACM or AMH anion exchange membranes (Tokuyama Soda Co.), Nafion* 324, 901, or 902 cation exchange membranes (DuPont), or Flemion* FCA cation exchange membrane. The cathode was 316 stainless steel or nickel, and the anode was either nickel, platinized titanium, shiny platinum, or DSA-$O_2$. Anolyte and catholyte samples (10 ml) were periodically taken and analyzed for ammonium sulfate (gravimetrically by evaporating and weighing) and sodium hydroxide (by titration vs. standardized HCl). Feed samples were also taken to determine caustic content by titration. The volumes of each compartment were measured at the end of the *Trade-Mark run to allow the calculation of the number of moles of ammonium sulfate and sodium hydroxide formed. Cell voltage and temperature were measured throughout the run and reported when steady state values had been reached towards the end of the run.

At the end of the runs, anolyte samples were analyzed by HPLC for nitrate ($NO_3^-$) content from $NH_3$ oxidation. A Waters* 600 HPLC equipped with a micro-Bondapak* C-18 column and UV detector (214 nm) was employed for the analysis. The mobile phase was 0.05M $KH_2PO_4$ with 0.025M PIC-A reagent (Waters), running at a flow rate of 2.5 ml/min. By comparing the sample nitrate peak area to that of a known standard, the anolyte nitrate concentration could be determined.

In flow cell runs where gaseous $NH_3$ addition was employed, the anolyte chamber was sealed so as to be gas tight and the off gases were scrubbed through a sealed trap containing dilute sulfuric acid to remove $NH_3$, and then sampled and analyzed for nitrogen. The concern was that nitrogen could be produced from the oxidation of ammonia, resulting in an excess amount of $NH_3$ required to form ammonium sulfate. Oxygen and nitrogen were separated and quantified on a molecular sieve 5A column mounted in a Perkin-Elmer* 8500 gas chromatograph equipped with a thermal conductivity detector. Helium was used as the carrier gas at a flow rate of 60 ml/minute and the injector and detector temperatures were set at 120° C. while the oven temperature was 70° C.

Table 2 summarizes the results of initial flow cell runs. The experiments were run to about 40% of complete theoretical conversion (300,000 coulombs) of sodium sulfate to ammonium *Trade-Mark sulfate and sodium hydroxide. Current efficiencies and concentrations are reported at the end of the runs. Because of overall volume losses of 50 to 100 ml seen in all flow cell runs, the current efficiencies reported show some variance.

The first experiment (#176-59) utilized a nickel anode which corroded into solution giving a purple color to the anolyte. When dimethyl glyoxime was added to anolyte samples, a red precipitate indicative of the presence of nickel was observed. The Neosepta ACM membrane was deeply discoloured in areas where it contacted the anolyte and feed solutions which contained ammonia.

The next experiment (#176-63) used a platinized titanium anode. This run was terminated when a rapidly rising cell voltage was observed after the passage of 380,000 coulombs. When the cell was inspected a number of holes were found in the ACM membrane indicating that it was not stable to alkaline solutions. The Pt/Ti anode had a thin coating of brown solids on it, indicating that it had corroded to a small extent.

A shiny platinum anode was used in the next experiment (#176-75) along with Neosepta AMH and Nafion 901 membranes. The AMH allowed a high current efficiency (99.4%) for $(NH_4)_2SO_4$ formation and showed no evidence of deterioration. The 901 membrane allows very high current efficiencies for caustic formation because it is a bilayer membrane which resists hydroxide back migration from the catholyte. However, it was not known if the membrane would be stable in the presence of high sulfate concentrations.

TABLE 2

STABILITY OF ANODE MATERIALS FOR ELECTRODIALYSIS OF SODIUM SULFATE IN MP FLOW CELL

| Experiment # | 176-59(a) | 176-63(a) | 176-75(b) | 176-79(b) |
|---|---|---|---|---|
| Coul. Passed ×1000 | 333 | 384 | 283 | 428 |
| Electrodes, Anode/Cathode | Ni/316SS | Pt-Ti/316SS | Pr/Ni | DSA-02/Ni |
| Membranes, Anion/Cation | ACM/324 | ACM/324 | AMH/901 | AMH/901 |
| Concentration, g/l | | | | |
| Amm. Sulfate | 249.3 | 260.7 | 250.4 | 300.9 |
| NaOH | 129.0 | 140.3 | 165.3 | 192.0 |
| % Current Efficiency | | | | |
| Amm. Sulfate | 100.8 | 107.4 | 99.4 | 98.5 |
| NaOH | 93.5 | 90.9 | 87.9 | 86.1 |
| Cell Voltage | 9.5 | 14 | 9.5 | |
| Temperature, °C. | 48 | 44 | 43 | 45 |
| Anolyte Wt. % Amm. Nitrate | 2.8 | 4.4 | 3.5 | 3.6 |
| Feed Conc. $NaOH_1$ g/l | — | — | 5.6 | 8.8 |
| Δ Volume, ml/1000 C | | | | |
| Anolyte | +1.34 | +1.49 | +0.92 | +0.91 |
| Catholyte | +0.78 | +0.80 | +0.71 | +0.69 |
| Feed | −1.64 | −2.66 | −1.88 | −1.80 |
| Δ Volume, overall ml | +168 | −179 | −68 | −85 |
| Anolyte pH | 10-12 | 8-10 | 8-10 | 8-10 |
| Anode Corrosion | Severe | Slight | Slight | None |
| Membrane Stability | ACM discolored | ACM failed | OK | OK |

(a)Starting Conditions: Amm. Sulfate 132.14 g/l, NaOH 40 g/l, Sodium Sulfate 249 g/l, 200 mA/sq. cm.
(b)Starting Conditions: Amm. Sulfate 132.14 g/l, NaOH 100 g/l, Sodium Sulfate 249 g/l, 200 mA/sq. cm.

Actual current efficiency for caustic formation (87.9%) is lower than expected, possibly due to caustic mist being entrained in the hydrogen off gas from the catholyte. A film of brown solids on the Pt anode indicated slight corrosion.

Glass cell tests indicated that DSA-$O_2$ was the most stable anode material. When used in flow cell run #176-79, no corrosion of the DSA-$O_2$ anode was seen. Again, high current efficiency for ammonium sulfate formation and relatively low current efficiency for sodium hydroxide formation were seen. At this point DSA-$O_2$/Ni and AMH were selected as the best electrode pair and anion exchange membrane for the process. Further flow cell tests focused on the stability of these materials as well as the optimal cation exchange membrane material.

Table 3 gives the results of flow cell tests designed to check the stability of the DSA-$O_2$ anode, AMH membrane, and various cation exchange membranes in repeated experiments. Previous experiment #176-79 had shown no corrosion of these materials. However, when this experiment was repeated (#176-84), a very thin film of brown solids was seen on the anode indicating slight corrosion, and the 901 membrane blistered, delaminating the two layers of this membrane. Good current efficiencies for product formation were observed. It was thought that reducing the free ammonia concentration in the anolyte would alleviate the corrosion of the DSA-$O_2$ anode, and thus further experiments were conducted at lower anolyte pH (less $NH_3$ added).

The next two experiments (#176-91 & 95) were performed at a neutral anolyte pH. Also, a higher current density (250 mA/cm$^2$) was employed in these experiments to more rigorously test the membranes. Under these conditions, slight anode corrosion was still observed and the cation exchange membrane failed, allowing caustic to leak into the feed compartment in the second experiment, thus lowering current efficiency for caustic formation. No damage to the AMH membrane was observed.

The 901 membrane was tried one more time in experiment #200-1 under less taxing conditions. Even with a lower initial caustic concentration and a lower current density, the membrane still blistered. The anolyte pH was lowered further to a range of 1-2. At this pH, some ammonium bisulfate may form and thus it was necessary to add extra ammonia to anolyte samples to ensure that only the sulfate form was present for analysis. No corrosion of the DSA-$O_2$ anode was observed. Also, much less ammonium nitrate was formed from the oxidation of ammonia than at higher pH values where an excess of ammonia was present (0.04% of the ammonium sulfate formed was ammonium nitrate vs. 4.0% in experiment #176-84). No nitrogen could be detected in anolyte off gases, indicating that ammonia was not being oxidized to nitrogen. Thus operation at a low anolyte pH seemed desirable and was tested further.

Two other cation exchange membranes were tested in the next three experiments (#200-6, 10, 14). Nafion 902 is another bilayer membrane similar to Nafion 901 but thinner. Damage to bilayer membranes by sulfate is known to be reduced as the membrane thickness decreases. Flemion FCA membrane is a monolayer perfluorinated carboxylic acid membrane which may not be damaged by sulfate. The experiments were performed at a current density of 200 mA/cm$^2$ and at the lower initial NaOH concentration of 40 g/l. The Nafion 902 membrane was undamaged after two experiments (#200-6 & 200-14). The current efficiencies for caustic formation are surprisingly low (92.6% and 86.2% for the two experiments) but large volume losses were seen in both experiments and thus current efficiencies may be suspect. Flemion FCA membrane (#200-10) was likewise undamaged after the run and gave a current efficiency for caustic formation similar to that seen for Nafion 902. At an anolyte pH of 1-2, no anode corrosion, no $N_2$ formation, and very little $NH_4NO_3$ formation was seen in these three experiments.

TABLE 3

STABILITY OF MEMBRANES AND DSA-02 ANODE FOR ELECTRODIALYSIS OF SODIUM SULFATE IN MP CELL

| Experiment # | 176-84(a) | 176-91(b) | 176-95(b) | 200-1(c) | 200-6(c) | 200-10(c) | 200-14(c) |
|---|---|---|---|---|---|---|---|
| Coul. Passed × 1000 | 322 | 360 | 625 | 382 | 275 | 297 | 362 |
| Electrodes, Anode/Cathode | DSA-02/Ni | DSA-02/Ni | DSA-02/Ni | DSA-02/Ni | DSA-02/Ni | DSA-02/Ni | DSA-02/Ni |
| Membranes, Anion/Cation | AMH/901 | AMH/901 | AMH/901 | AMH/901 | AMH/902 | AMH/ Flemion FCA | AMH/902 |
| Concentration, g/l | | | | | | | |
| Amm. Sulfate | 286.9 | 280.6 | 326.5 | 270.7 | 258.0 | 254.6 | |
| NaOH | 173.2 | 187.2 | 230.2 | 139.4 | 123.6 | 127.8 | 148.2 |
| % Current Efficiency | | | | | | | |
| Amm. Sulfate | 97.9 | 93.9 | 83.8 | 91.8 | 93.1 | 100 | |
| NaOH | 95.0 | 95.8 | 70.3 | 34.9 | 92.6 | 87.4 | 86.2 |
| Cell Voltage | 8.6 | 9.7 | 10.2 | 9.5 | 8.7 | 9.0 | 8.7 |
| Temperature, °C. | 44 | 50 | 51 | 48 | 46 | 46 | 46 |
| Anolyte Wt. % Amm. Nitrate | 4.0 | 0.3 | 0.4 | 0.04 | 0.02 | 0.02 | |
| Feed Conc. NaOH, g/l | 0 | 2.0 | 30.8 | 5.1 | 0.9 | 4.8 | 4.0 |
| Δ Volume, ml/1000 C | | | | | | | |
| Anolyte | +0.59 | +0.85 | +0.82 | +0.99 | +0.67 | +1.35 | +0.60 |
| Catholyte | +0.91 | +0.94 | +0.35 | +0.30 | +0.60 | +0.55 | +0.45 |
| Feed | −1.64 | −1.86 | −1.34 | −1.44 | −2.35 | −2.21 | −2.39 |
| Δ Volume, overall ml | −45 | −26 | −108 | −58 | −116 | −92 | −166 |
| Anolyte pH | 9-10 | 6-8 | 7-10 | 1-2 | 1-2 | 1-2 | 1-2 |
| Anode Corrosion | Slight | Slight | Slight | None | None | None | None |
| Cation Exchange Membrane Stability | Blistered slightly | Blistered heavily | Blistered heavily | Blistered heavily | OK | OK | OK |

(a)Starting Conditions: Amm. Sulfate 132.14 g/l, NaOH 100 g/l, Sodium Sulfate 249 g/l, 200 mA/sq. cm.
(b)Starting Conditions: Amm. Sulfate 132.14 g/l, NaOH 100 g/l, Sodium Sulfate 249 g/l, 250 mA/sq. cm.
(c)Starting Conditions: Amm. Sulfate 132.14 g/l, NaOH 40 g/l, Sodium Sulfate 249 g/l, 200 mA/sq. cm.

COMPARATIVE EXAMPLE

Electrolytic Production of Sodium Hydroxide and Sulfuric Acid.

Flow cell electrolyses of Glauber's salt purified as described in Example 2 were performed in an MP Cell (Electrocell, Sweden) using a three compartment configuration shown in FIG. 1. A stainless steel cathode and an DSA-$O_2$ anode were used for all the experiments.

In a typical experiment the compartments were charged with the following solutions:

| | |
|---|---|
| Catholyte | 1L, NaOH (0.11M) |
| Center compartment | 2L, $Na_2SO_4$ (2M) |
| Anolyte | 1L, $H_2SO_4$ (0.09M) |

The solutions were circulated through the cell at a flow rate of 0.4 gal/min. A constant current of 20 amps (200 mAcm$^{-2}$) was passed through the cell and the charge followed using a coulometer (Electrosynthesis Company) in the circuit. Samples (2 ml) were removed from the catholyte and the anolyte reservoirs at intervals and the concentration determined by titration against standardized acid and base. The temperature and cell voltages were recorded once they had reached a constant value, towards the end of the reaction. The volumes of the electrolytes were measured at the end of the reaction to allow the calculation of the number of moles of sodium hydroxide and sulfuric acid formed.

Membranes used include AM-1 and ACM membrane (Neosepta, Tokuyama Soda), ARA membrane (Morgane, France) and Nafion 324 and 901 membranes (DuPont).

The current efficiency for the formation of both sodium hydroxide and sulfuric acid was determined over a range of operating conditions. The results are summarized in Table 4.

As can be seen from a comparison of runs 3 and 5, the current efficiency is affected only slightly by increasing the current density. However, increasing the current density does increase the cell voltage, approximately one volt for a 100 mAcM$^{-2}$ increase. The flow rate also seems to have only a minor effect on the current efficiency. If the flow rate is too low, however, it could lead to trapped gas bubbles on the electrode or the membrane, which will increase the cell voltage.

In experiments 1 to 5, when an AM-1 anion exchange membrane was used, there was a significant migration of protons into the center compartment. This lowers the current efficiency for the production of sulfuric acid (measured in the anolyte only). It also, eventually, leads to competition between protons

TABLE 4

| Summary of Results | Experiment Number | | | | | | | | | |
|---|---|---|---|---|---|---|---|---|---|---|
| | 1[A] | 2[A] | 3[A] | 4[A] | 5[A] | 6[A] | 7[B] | 8[B] | 9[B,C] | 14[A] |
| Membranes | | | | | | | | | | |
| Cation | 324 | 324 | 324 | 324 | 324 | 324 | 324 | 324 | 901 | 324 |
| Anion | AM-1 | AM-1 | AM-1 | AM-1 | AM-1 | ACM | ACM | ARA | ACM | ACM |
| Current density/mA $cm^{-2}$ | 100 | 200 | 200 | 200 | 350 | 200 | 300 | 250 | 250 | 200 |
| Flow Rate/ gal $min^{-1}$ | 0.4 | 0.4 | 0.4 | 0.1 | 0.4 | 0.4 | 0.4 | 0.4 | 0.4 | 0.4 |
| Charge passed/ Coulombs × 1000 | 289 | 302 | 580 | 288 | 617 | 388 | 605 | 642 | 600 | 381 |
| Wt Percentage | | | | | | | | | | |
| NaOH | 9.4 | 9.2 | 13.1 | 9.1 | 13.8 | 11.4 | 13.6 | 14.1 | 28[D] | 16 |
| $N_2SO_4$ | 9.4 | 9.4 | 13.1 | 9.7 | 15.7 | 16.2 | 19.9 | 18.3 | 18.1 | 16.6 |
| Wt Percentage $H_2SO_4$ in center compartment | 5.2 | 4.1 | 5.8 | 2.3 | 4.6 | 1.8 | 2.2 | 5.3 | 3.0 | 3.3 |
| Cell Voltage | 5.2 | 6.2 | 6.5 | 6.5 | 7.5 | 7.4 | 9.2 | 7.7 | 5.5 | 7.6 |
| Temperature/°C. | 35 | 42 | 43 | 45 | 54 | 42 | 47 | 43 | 45 | 48 |
| Current Efficiency after 250,000 Coulombs | | | | | | | | | | |
| NaOH | 93 | 90 | 89 | 92 | 84 | 90 | 99 | 94 | 90 | 95 |
| $H_2SO_4$ | 61 | 51 | 60 | 55 | 66 | 84 | 83 | 66 | 75 | 73 |
| 500,000 Coulombs | | | | | | | | | | |
| NaOH | — | — | 79 | — | 78 | — | 86 | 86 | 85 | — |
| $H_2SO_4$ | — | — | 50 | — | 56 | — | 72 | 61 | 65 | — |
| Final solution Volumes/ml | | | | | | | | | | |
| Catholyte | 1178 | 1238 | 1376 | 1211 | 1444 | 1295 | 1514 | 1526 | 961 | 1287 |
| Anolyte | 988 | 938 | 1100 | 969 | 1134 | 1100 | 1124 | 1116 | 1046 | 1074 |
| Center compartment | 1800 | 1700 | 1440 | 1750 | 1400 | 1590 | 1310 | 1390 | 1626 | 1512 |
| loss/gain ml | −36 | −124 | −84 | −70 | −22 | −15 | −52 | +32 | −117 | −127 |
| Proton balance moles $H^+$-moles $OH^-$ (moles formed) | +0.15 | −0.33 | +0.17 | −0.4 | −0.11 | +0.43 | −0.11 | +0.12 | −0.443 | −0.02 |

Notes:
[A]Reagent grade sodium sulfate 2M, 2 l;
[B]Purified Glauber salt. 2M, 2 L;
[C]NaOH starting concentration 5M, 750 ml;
[D]Starting Wt percentages NaOH 19%

Two other anion exchange membranes were therefore investigated in an to attempt to minimize the proton migration. The membranes tested were ACM (Neosepta) and ARA (Morgane). The ARA gave current efficiencies very similar to that observed for the AM-1 membrane, thereby showing no significant advantage over the previous results. The ACM membrane, however, gave a 20% increase in the current efficiency for the production of sulfuric acid and approximately halved the proton migration into the center compartment. The use of this membrane, however, leads to an increase of approximately one volt in the total cell voltage, compared to the AM-1 membrane.

When sodium ions are transported across the cation exchange membrane, water is also transported across the membrane, which leads to a diluting effect on the concentration of sodium hydroxide formed. This limits the concentration of sodium hydroxide which can be attained. The concentration of sodium hydroxide which can be achieved is also limited by the back migration of hydroxide ions, across the cation exchange membrane. The Nafion 324 cation exchange membrane limits the maximum concentration of sodium hydroxide which can be produced, to about 15–20%. The maximum concentration which may be produced can, in theory, be improved by using a Nafion 901 membrane. This membrane limits the back migration of hydroxide ions by using a bilayer structure in the membrane. This membrane is, however, more sensitive than the 324 membrane to the presence of heavy metal ion hydroxides. It is also sensitive to the pH of the center compartment. This phenomenon was discovered during some of the later experiments performed, by observation of the membrane itself. Too low a pH causes the membrane to blister and thereby damaging it beyond repair. According to manufacturer's data the membrane should not be run at pH less than 2 even on the anolyte side of the membrane.

Experiment 14 was run with the optimum cell configuration, i.e. a Nafion 324 cation exchange membrane and a Neosepta ACM anion exchange membrane. The current efficiency for NaOH and $H_2SO_4$ at 16% by weight concentration is 95% and 73% respectively. The water transport across these membranes has been estimated at three molecules of water accompanying every sodium ion transported across the Nafion membrane and two molecules of water with every sulfate ion transported across the ACM membrane.

What we claim as our invention is:

1. A process for producing sodium hydroxide, which process comprises electrolysing an aqueous solution of sodium sulfate in an electrolytic cell having at least one anode compartment and at least one cathode compartment, said anode compartment containing an anolyte and having an anode located therein, said cathode compartment containing a catholyte and having a cathode located therein, said anode compartment and said cathode compartment being separated from the sodium sulfate solution by an anion selective ion exchange membrane and a cation selective ion exchange membrane, respectively, wherein during the process ammonia is added to the anolyte to at least partially neutralize sulfuric acid produced in the anode compartment.

2. A process for producing sodium hydroxide and ammonium sulfate, which method comprises:

passing a solution of sodium sulfate through a central compartment of a three-compartment electrolytic cell having a cathode compartment and an anode compartment separated from the central compartment by a cation selective ion exchange membrane and an anion selective ion exchange membrane, respectively;

passing a catholyte through the cathode compartment and an anolyte through the anode compartment;

passing a direct electric current between an anode and a cathode located in the anode compartment and the cathode compartment, respectively, thus producing sodium hydroxide in the cathode compartment and sulfuric acid in the anode compartment;

at least partially neutralizing sulfuric acid produced in the anode compartment by adding ammonia to the anolyte.

3. A process according to claim 1 or 2, wherein sulfuric acid is neutralized to maintain the anolyte at a pH of less than about 7.

4. A process according to claim 3, wherein sulfuric acid is neutralized to maintain the anolyte at a pH of less than about 2.

5. A process according to claim 1 or 2, wherein the liquid ammonia is added to the anolyte.

6. A process according to claim 1 or 2, wherein gaseous ammonia is added to the anolyte.

7. A process according to claim 1 or 2, wherein the starting concentration of the sodium sulfate solution is from about 0.1M to about the solubility limit.

8. A process according to claim 7, wherein the starting concentration of the sodium sulfate solution is from about 1M to about 3.5M.

9. A process according to claim 8, wherein the starting concentration of the sodium sulfate solution is from about 2M to about 3M.

10. A process according to claim 1 or 2, wherein the catholyte is an aqueous solution of sodium hydroxide having the starting concentration of from about 0.01M to about 9M.

11. A process according to claim 10, wherein the starting concentration of sodium hydroxide solution is about 3M.

12. A process according to claim 1 or 2, wherein the anolyte is an aqueous solution of ammonium sulfate having the starting concentration of from about 0.01M to about 3.5M.

13. A process according to claim 1 or 2, wherein the cation selective ion exchange is made of an organic polymer having sulphonate or carboxylate groups attached thereto.

14. A process according to claim 1 or 2, wherein the cation selective ion exchange membrane is a stable perfluorinated cation exchange membrane.

15. A process according to claim 1 or 2, wherein the cation selective ion exchange membrane is NAFION 902 or FLEMION FCA membrane.

16. A process according to claim 1 or 2, wherein the anion selective ion exchange membrane is made of an organic polymer having amino functionality attached thereto.

17. A process according to claim 1 or 2, wherein the anion selective ion exchange membrane is NEOSEPTA AMH membrane.

18. A process according to claim 1 or 2, wherein a low hydrogen overpotential cathode is used.

19. A process according to claim 18, wherein the cathode is made of a material selected from the group consisting of nickel, stainless steels and spinels.

20. A process according to claim 1 or 2, wherein a low oxygen overpotential anode is used.

21. A process according to claim 20, wherein the anode is a nobel metal oxide anode or DSA-$O_2$ anode.

22. A process according to claim 1 or 2, wherein the process is carried out in a batch mode.

23. A process according to claim 1 or 2, wherein the process is carried out in a continuous mode.

24. A process for producing sodium hydroxide, which process comprises electrolysing an aqueous solution of sodium sulfate in an electrolytic cell having at least one anode compartment and at least one cathode compartment, said anode compartment containing an anolyte and having an anode located therein, said cathode compartment containing a catholyte and having a cathode located therein, said anode compartment and said cathode compartment being separated from the sodium sulfate solution by an anion selective ion exchange membrane and a cation selective ion exchange membrane, respectively, wherein during the process ammonia is added to the anolyte to at least partially neutralize sulfuric acid produced in the anode compartment, and wherein the cation selective ion exchange membrane is a stable perfluorinated cation exchange membrane, the anion selective ion exchange membrane is made of an organic polymer having amino functionality attached thereto, the cathode is a nickel cathode and the anode is a DSA-$O_2$ anode and sulfuric acid is neutralized to maintain the anolyte at a pH of from about 0.5 to about 3.5.

* * * * *